US005165961A

United States Patent [19]

Freeman

[11] Patent Number: 5,165,961

[45] Date of Patent: Nov. 24, 1992

[54] METHOD OF REMOVING PULSES AND METERING FLOW IN AN ADHESIVE DISPENSING SYSTEM

[76] Inventor: Harvey S. Freeman, 1980 Somerset Ct., Troy, Mich. 48084

[21] Appl. No.: 640,076

[22] Filed: Jan. 11, 1991

[51] Int. Cl.[5] ..... B05D 5/10

[52] U.S. Cl. ..... 427/207.1; 118/323; 118/410; 118/DIG. 2; 222/1; 222/373; 222/380; 222/386.5; 222/389; 427/284; 427/287

[58] Field of Search ..... 427/429, 207.1, 284, 427/287; 118/323, 410, 407, DIG. 2; 222/1, 372, 380, 386.5, 389

[56] References Cited

U.S. PATENT DOCUMENTS

| | | | |
|---|---|---|---|
| 3,961,599 | 6/1976 | Jones, Jr. | 118/410 X |
| 4,043,683 | 8/1977 | Costa et al. | 118/410 X |
| 4,508,051 | 4/1985 | Bast | 118/410 |
| 4,564,410 | 1/1986 | Clitheros et al. | 118/323 X |
| 4,635,827 | 1/1987 | Roedig | 118/410 X |
| 4,800,837 | 1/1989 | Ferragni | 118/323 X |
| 4,857,367 | 8/1989 | Thorn et al. | 118/323 X |

FOREIGN PATENT DOCUMENTS

| | | | |
|---|---|---|---|
| 2299628 | 8/1976 | France | 222/380 |

*Primary Examiner*—Shrive Beck
*Assistant Examiner*—Terry J. Owens
*Attorney, Agent, or Firm*—Dykema Gossett

[57] ABSTRACT

A system and method for dispensing a viscous adhesive onto a glass member to be attached to a vehicle body is disclosed. A reciprocating pump supplies adhesive to a dispensing point, with a pulse dampener member disposed between the pump and the dispensing point. A rolling diaphragm defines two chambers within the pulse dampener member, with the adhesive being communicated into a first variable volume chamber. A pressurized gas force is maintained on the opposite side of the diaphragm from the first variable volume chamber. The pulse dampener member includes a T-connection, with the pump supplying fluid into a first leg, the second leg being connected to the variable volume chamber and the third leg connected to the dispensing point. As fluid enters the first leg, the amount of fluid demanded at the dispensing point moves from the first leg directly into the third leg. Any excess fluid supplied into the first leg moves upwardly into the variable volume chamber through the second leg. Should there be a deficiency in the amount of adhesive supplied by the pump, as would typically occur during low flow rate portions of the cycle of the reciprocating pump, the force from the pressurized gas chamber forces the rolling diaphragm to reduce the volume of the variable volume chamber and dispense fluid stored in the variable volume chamber into the third leg. A rotary valve is mounted at the dispensing point to provide accurate and rapid control of the amount of fluid dispensed. Most preferably, the rotary valve is mounted to a robot arm, and the pulse dampener member is mounted to a base of the robot.

12 Claims, 3 Drawing Sheets

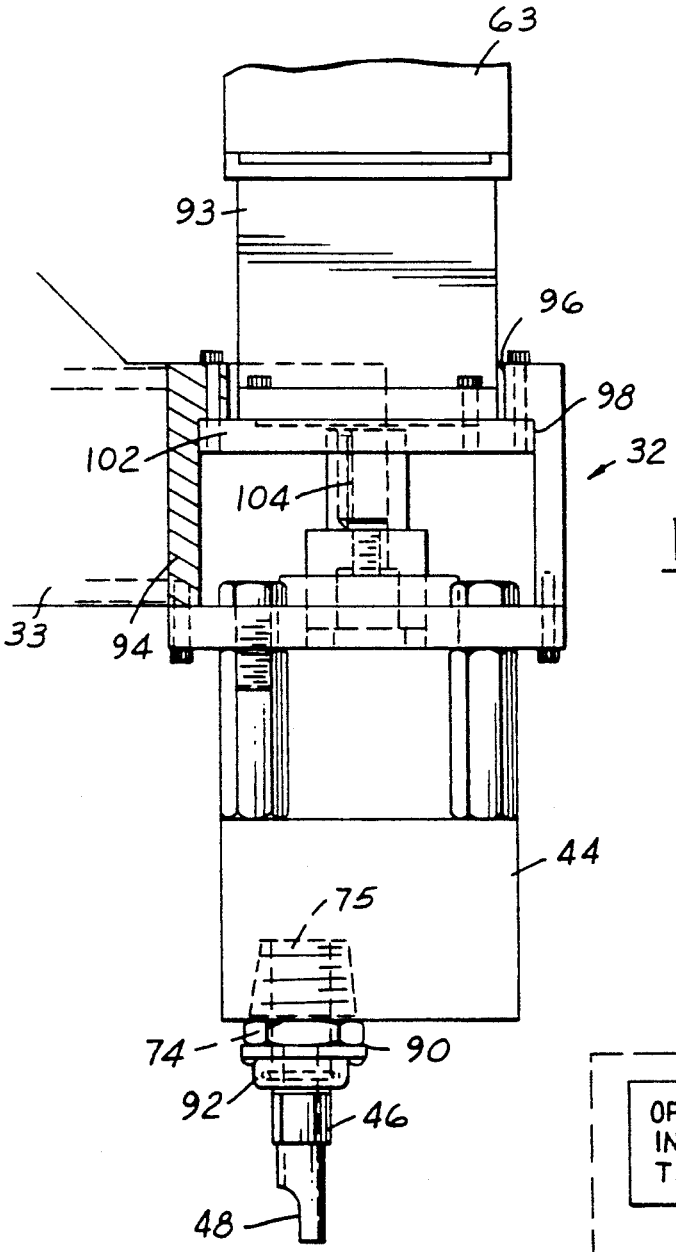
FIG. 10
FIG. 11
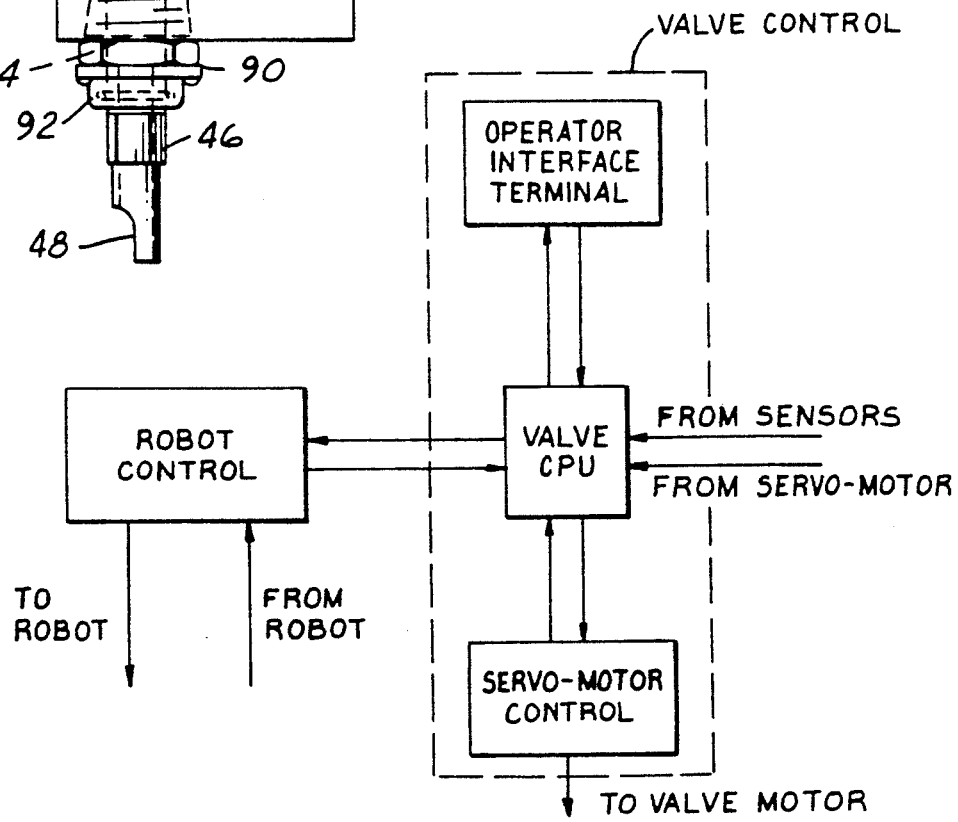

METHOD OF REMOVING PULSES AND METERING FLOW IN AN ADHESIVE DISPENSING SYSTEM

BACKGROUND OF THE INVENTION

This application relates to a system for dispensing a desired amount of a viscous fluid at a dispensing point. More particularly, the disclosed invention provides accurate metering of the quantity of viscous fluid dispensed.

Viscous fluids are generally difficult to pump or dispense. Rotary pumps may not adequately move a viscous fluid, and thus reciprocating pumps are typically utilized. As is known, the use of a reciprocating pump results in pulses in the fluid flow downstream of the pump. When the reciprocating pump is charging, or receiving fluid to be pumped in its chamber, no fluid is being discharged and there is a substantial reduction in the rate of fluid flow. These low points in the flow rate cycle typically alternate with high flow pulses which occur as the pump does discharge. In order to reduce the duration and extent of these low flow rate points, double-acting reciprocating pumps are sometimes utilized. In such pumps, opposed faces of a piston are typically driven to empty pump chambers 180° out of phase from each other such that the time period between discharges of a pump chamber is reduced. The use of the two pump chambers attempts to align the discharge of one pump chamber with the low flow rate portion of the cycle which occurs during filling of the other pump chamber. Even with double-acting pumps, however, there is a period of time between the discharging of the two chambers in which neither chamber is discharging. This time delay causes undesirable irregularities and low flow rates in the total fluid flow. If such periodic low flow rates occur at a dispensing point, it becomes difficult to dispense a desired amount of fluid, or to accurately meter the rate and amount of fluid dispensed, since there may not be uniform flow of fluid at the dispensing point.

Also, in order to move highly viscous fluids it becomes necessary for the pump to generate very large pressures in the fluid. Tubing which may connect the pump to the distribution point may expand due to the high fluid pressure. This expansion can allow the fluid pressure to drop, causing further problems in supplying a desired amount of fluid to the distribution point.

Further, it is difficult to accurately meter viscous fluids from a reciprocating metering valve, such as a needle valve. High pressure, high viscosity fluids may resist movement of the reciprocating valve member, thus making it difficult to accurately and rapidly control the amount of fluid dispensed.

The above-discussed problems exist in dispensing viscous adhesives, and in particular adhesives used to secure glass members to a vehicle body. Urethane adhesives, typically utilized for this purpose, are non-Newtonian fluids that are highly viscous. One such urethane adhesive has a viscosity of 6,000,000 centipoise. Urethane adhesives typically include an isocynate prepolymer and a catalyst. One particular adhesive which utilizes water as the catalyst, is formulated to begin curing immediately upon leaving the distribution nozzle, when it is exposed to water vapor in ambient air.

Urethane adhesives are expensive and thus it is desirable to reduce the amount utilized to the minimum required to achieve the desired results. The amount of adhesive needed often varies with location on the members to be joined. As an example, it may be necessary to have a greater amount of adhesive at the sides or bottom of a vehicle windshield than is needed at the top of the windshield. For this reason it is desirable that the adhesive be accurately metered when dispensed onto a member to avoid waste.

In known systems, a double-acting reciprocating pump is mounted on top of a cylinder containing the urethane adhesive. In order to supply the viscous fluid to the inlet of the pump, an arrangement known as a pressure primer is utilized. A pressure primer includes a plate forced downwardly into the cylinder to move the urethane adhesive up to the inlet of the pump. As discussed above, the double reciprocating pump used to move the adhesive to the dispensing point typically results in pulses in the flow. In response to this problem, one prior art device has utilized a "shot-meter" system to eliminate any short-term deficiency of adhesive caused by the low flow rate portions of the cycle. Shot-meter systems as used in this prior art system include a pair of large cylinders that are alternately communicated to the reciprocating pump such that one cylinder is always receiving adhesive from the reciprocating pump. The second cylinder is typically being driven to discharge adhesive that had previously been stored and force it to the dispensing point.

In such shot-meter systems, the cylinder receiving fluid may have a piston floating upwardly until the piston contacts a switch. The switch reverses valves such that the cylinder which was previously discharging begins to receive fluid from the pump, while the other cylinder forces fluid to a dispensing point.

While shot-meters do eliminate pulses in fluid flow, they are complex, heavy, require large amounts of floor space and are expensive. Some prior art systems have utilized nozzles mounted to a robotic manipulator. One such system suggests positioning a shot-meter system on a robot arm, so that the relatively pulseless flow out of the shot-meter system will reach the nozzle prior to travelling through long lengths of tubing. In practice, however, the size of the shot-meter system may make it impractical to position it as close to the nozzle as desired.

Further, shot-meter systems include several surface areas that must be tightly sealed. The adhesives typically utilized to secure vehicle glass cannot be exposed to air while in the shot-meter system or they will begin to cure. This increases the complexity of the shot-meter system.

Also, the shot-meter system typically stores fluid in one cylinder while discharging fluid from the other cylinder. All fluid dispensed is stored for at least a temporary period of time in a cylinder. This is undesirable, at least with the particular adhesive identified above, since the adhesive begins to cure upon contact with air. Even though a shot-meter system is designed to be air-tight it is still desirable to move the adhesive to a dispensing point as quickly as possible, and not leave it stored in any intermediate member for any unnecessary length of time since there could be air leakage. Further, the requirement that all of the adhesive to be dispensed be stored in a cylinder increases the size of the shot-meter cylinders.

In the known system mentioned above, a reciprocating tapered pin is used in the metering valve. As discussed above, reciprocating pins are not capable of accurately and rapidly metering viscous fluids. The metering valve is attached to an arm of a robotic manipulator which moves the nozzle about a first member to dispense adhesive on the first member. In this system, a reciprocating pump and pressure primer arrangement is communicated to a shot-meter system, which is in turn communicated to the reciprocating metering nozzle mounted on a robot arm. The overall arrangement is large and requires a great deal of floor space in an assembly area. In particular, the shot-meter system requires a large amount of floor space. In designing a system to be utilized in modern assembly environments it is preferred that a minimum floor space be utilized.

For the above reasons, it is an object of the present invention to provide a system and method for accurately and rapidly metering a desired amount of viscous fluid to a dispensing point. More particularly, it is an object of the present invention to provide such a system and method utilized to meter a desired amount of a viscous adhesive onto a first member which is to be attached to a second member.

SUMMARY OF THE INVENTION

In a disclosed embodiment of the present invention, a system for dispensing a viscous fluid includes a supply arrangement pumping the viscous fluid to a sealed pulse dampener chamber. The pulse dampener chamber sends a relatively pulseless flow of fluid to a metering nozzle. Preferably, the sealed pulse dampener chamber is of the type including a variable volume chamber receiving fluid and having a force tending to reduce the volume of the variable volume chamber. This force tends to move fluid out of the variable volume chamber, and eliminates any low flow rate portions of the pumping cycle occurring in the supply arrangement.

In a preferred embodiment of the present invention, the supply arrangement is communicated to a first leg of a T-connector, which is a portion of the pulse dampener system and has a second leg extending into the variable volume chamber. The third leg is connected to a fluid line leading to the dispensing nozzle. As fluid flows into the first leg it passes through a check valve. Should the amount of fluid sent from the supply arrangement into the first leg exceed the present demand for fluid at the nozzle, the excess fluid moves through the second leg and into the variable volume chamber. Should there be a deficiency in the amount of fluid sent into the first leg, as may occur during low flow rate portions of the cycle of a reciprocating pump, this deficiency will be supplemented by fluid which has been previously stored in the variable volume chamber. The force reducing the volume of the variable volume chamber will force fluid outwardly of the chamber to flow through the third leg, and to the dispensing nozzle.

Since the variable volume chamber only stores excess fluid which exceeds the present demand of the dispensing nozzle, the chamber need not be prohibitively large. The majority of adhesive to be dispensed can pass from the first leg directly to the third leg.

In one preferred embodiment of the present invention, the pulse dampener chamber includes a rolling diaphragm separating the variable volume chamber from a pressurized chamber that is maintained under a high gas pressure. This preferred embodiment has relatively few surface areas that must be sealed when compared to shot-meter systems.

In a most preferred embodiment of the present invention a metering nozzle includes a rotary valve having an electric control. The rotary valve shears, or cuts across the flow of, the viscous fluid, rather than parallel to the flow of the fluid. Thus, the pressure of the fluid does not affect valve speed or metering accuracy.

The present invention preferably dispenses an adhesive onto a first member which is to be attached to a second member. The adhesive is preferably metered such that it is of a desired amount at any location on the first member. In a most preferred embodiment of the present invention the first member is a glass member to be attached to a vehicle body.

The dispensing nozzle is preferably mounted as an end effector on a robot manipulator. The pulse dampening chamber is preferably mounted on the rotating base of the robot such that it is close to the metering nozzle, and long lengths of connecting tubing are not required.

The overall system provides higher flow rates than prior art systems. This is at least partially due to the fact that the inventive systems allows the use of higher fluid pressure and larger diameter fluid lines.

These and other objects and features of the present invention can be best understood from the following specification and drawings, of which the following is a brief description.

BRIEF DESCRIPTION OF THE DRAWINGS

FIG. 10 is a cross-sectional view through the nozzle assembly shown in FIG. 5.

FIG. 11 is a schematic view of a controller for the inventive system.

DETAILED DESCRIPTION OF A PREFERRED EMBODIMENT

Figure 1:
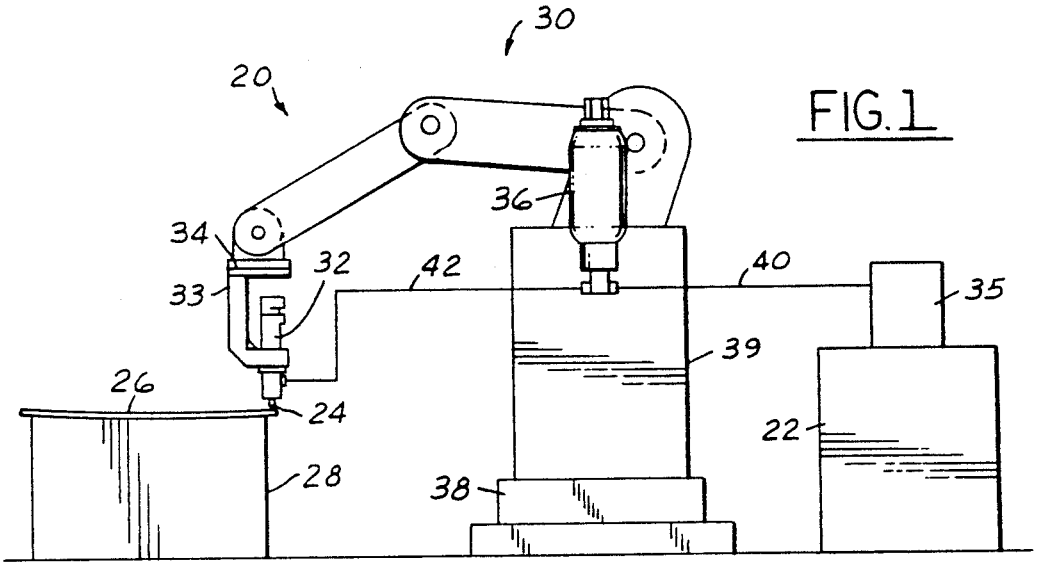
FIG. 1 is a largely schematic side view of a dispensing system according to the present invention.

An adhesive dispensing system 20 according to the present invention is illustrated in FIG. 1. Supply canister 22 supplies an adhesive through system 20 to dispensing point 24, and onto the outer periphery of windshield 26, which is mounted on stand 28. Windshield 26 may then be mounted on a vehicle body.

Robotic manipulator 30 for moving dispensing point 24 about the outer periphery of windshield 26 is schematically shown. Any type of robotic manipulator for moving dispensing point 24 can be used within the teachings of this invention. Further, embodiments of the invention extend to stationary or hand held dispensing members.

Nozzle assembly 32 is an end effector that dispenses adhesive onto windshield 26, and is mounted through mount assembly 33 to mounting portion 34 of robot 30.

Further details of nozzle assembly 32 and mounting assembly 33 are disclosed below.

Reciprocating pump 35 supplies adhesive from canister 22 to pulse dampener 36 mounted on base 38 of robot 30, vertically above dispensing point 24. Base 38 rotates about a vertical axis but does not move vertically. As base 38 rotates to move assembly 32 pulse dampener 36 also rotates. This reduces twisting in a fluid supply line 42. Mount arrangement 39 is shown schematically, but would preferably include a bracket arrangement. First supply line 40 extends from reciprocating pump 35 to pulse dampener 36, and second supply line 42 extends from pulse dampener 36 to nozzle assembly 32. Pump 35 is preferably a double-acting reciprocating pump and would preferably also utilize a pressure primer as is known in the prior art.

Figure 2:
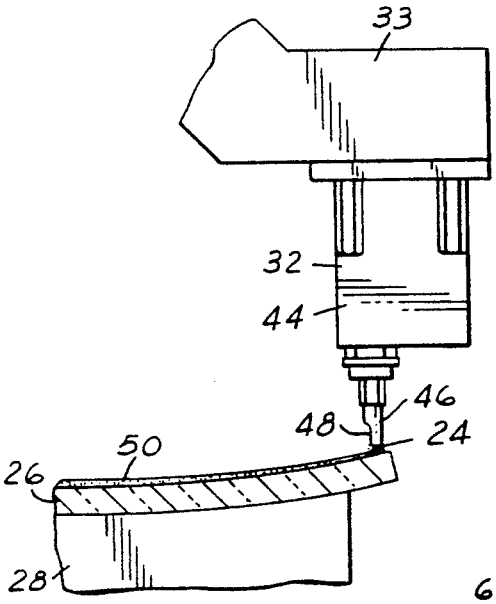
FIG. 2 is an enlarged view of a dispensing nozzle according to the present invention.

As shown in FIG. 2, nozzle assembly 32 includes rotary valve 44 which meters the amount of adhesive dispensed to nozzle tip 46, which has slot 48 to shape a dispensed bead 50 of adhesive. Rotary valve 44 controls the thickness or height of bead 50 on windshield 26. The height or width of bead 50 is preferably controlled to be the minimum necessary at each point along the outer periphery of windshield 26. As an example, bead 50 is illustrated thicker near the left side of the figure, and becoming thinner near the right side. This schematically shows that the thickness of bead 50 may vary around the periphery of windshield 26. In practice, the thicknesses might be different for different sides of windshield 26, rather than varying along a single side. Further, robot 30 would rotate nozzle tip 46 such that slot 48 faces away from the direction of travel on windshield 26 to properly shape bead 50.

An electronic control and motor, disclosed below, controls rotation of rotary valve 44 to meter the amount of adhesive dispensed at nozzle tip 46. The electronic control is programmed in combination with robot 30 such that the amount of adhesive dispensed at any point on the periphery of windshield 26 is controlled to be as required at that point, as robot 30 moves nozzle tip 46 about the periphery of windshield 26. Preferably, the periphery of windshield 26 is divided in a plurality of zones, and a desired amount of adhesive is determined for each zone.

Figure 3:
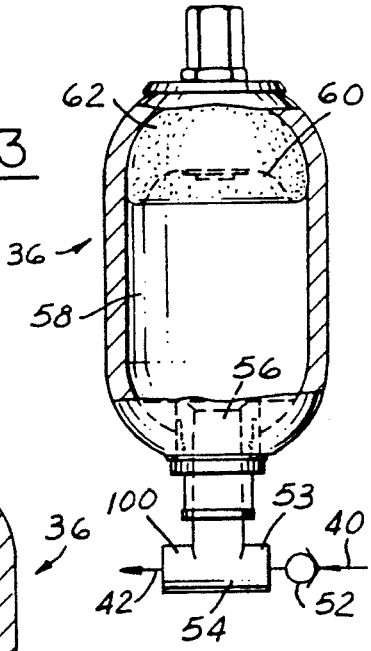
FIG. 3 is a side view of a pulse dampener chamber according to the present invention in a storage state.

Details of pulse dampener 36 are illustrated in FIG. 3. First line 40 leads through check valve 52 into a first leg 53 of T member 54, which is a portion of the pulse dampener system. A central leg 56 extends into variable volume chamber 58. Chamber 58 is separated by rolling diaphragm 60 from pressurized chamber 62. Pressurized chamber 62 is maintained under high gas pressure to bias rolling diaphragm 60 downwardly as illustrated in this figure, and reduce the volume of variable volume chamber 58. Third leg 100 of T member 54 leads to second line 42, and is connected directly to rotary valve 44.

Figure 4:
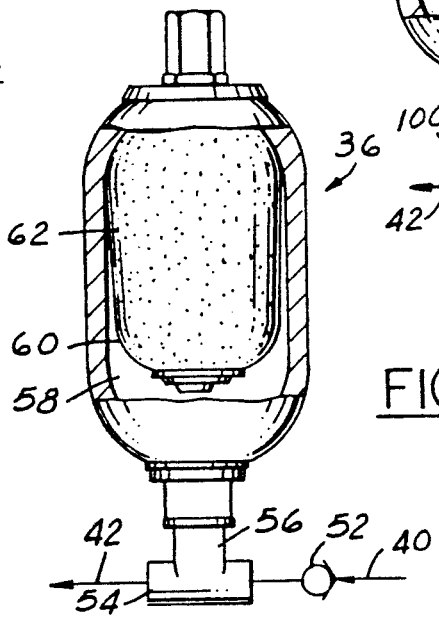
FIG. 4 is a view similar to FIG. 3, showing the pulse dampener chamber in a dispensing state.

In operation, pulsating flow from pump 35 is received from line 40, through check valve 52 and into leg 53. Any excess amount of adhesive not demanded immediately by nozzle assembly 32 moves through central leg 56, and into variable volume chamber 58. There, such excess fluid forces diaphragm 60 upwardly against the pressure chamber 62. Adhesive to meet the immediate demand moves from first leg 53 directly into third leg 100. Should an insufficient amount of adhesive be sent by reciprocating pump 35 to satisfy the immediate demand of nozzle assembly 32, the force in pressurized chamber 62 moves rolling diaphragm 60 downwardly towards the position illustrated in FIG. 4. This forces previously stored adhesive out of variable volume chamber 58 to ensure an even flow of adhesive to line 42 and rotary valve 44. In this way, pulse dampener 36 ensures that pulses from reciprocating pump 35 will be effectively reduced to even out the rate of flow reaching rotary valve 44.

Pulse dampener 36 may optically include a shut-off valve to block flow from chamber 58 into line 56. This valve would be closed if diaphragm 60 breaks allowing gas from chamber 62 to enter chamber 58. The shut-off valve could be connected to a controller such that it is automatically controlled, or it could be manually closed. Further, a normally closed blow-off valve would preferably be mounted between the shut-off valve and chamber 58. This valve would be opened when the shut-off valve is closed to allow the gas to escape.

Pulse dampener 36 is simple, inexpensive, lightweight and small. It has few connections which must be sealed to prevent air leakage, and does not store the adhesive for any long period of time. Although sealed chambers of this sort are known, they have not been utilized for reducing pulses from viscous fluids, and in particular have not been used for reducing pulses from adhesives used to secure glass members to vehicle bodies.

Figure 5:
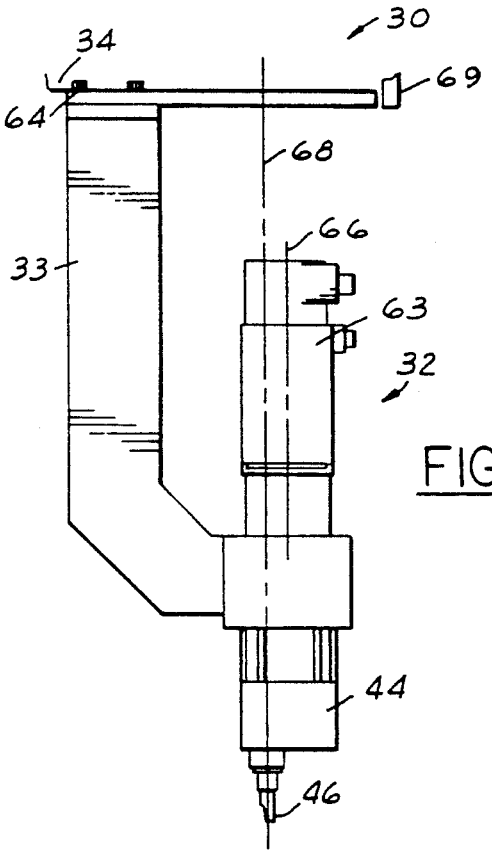
FIG. 5 is a side view of a nozzle assembly according to the present invention.

FIG. 5 is a side view showing details of nozzle assembly 32. An electric motor and control 63 controls valve 44. Bolts 64 connect mounting arrangement 33 to mounting portion 34 on robot 30. Mounting portion 34 is off-set from a central axis 68 of robot 30. The central axis 66 of the majority of nozzle assembly 32 is also off-set from a central axis of nozzle tip 46, which is coaxial with the central axis 68 of robot 30. Thus, as robot 30 moves nozzle assembly 32 about the surface of windshield 26, the position of nozzle tip 46 will correspond to a center position as programmed into robot 30. A proximity detector 69, shown schematically, is mounted on robot 30 and monitors the relative position of assembly 32. Should assembly contact an obstruction it will move, and proximity detector 69 will detect that movement.

Figure 6:
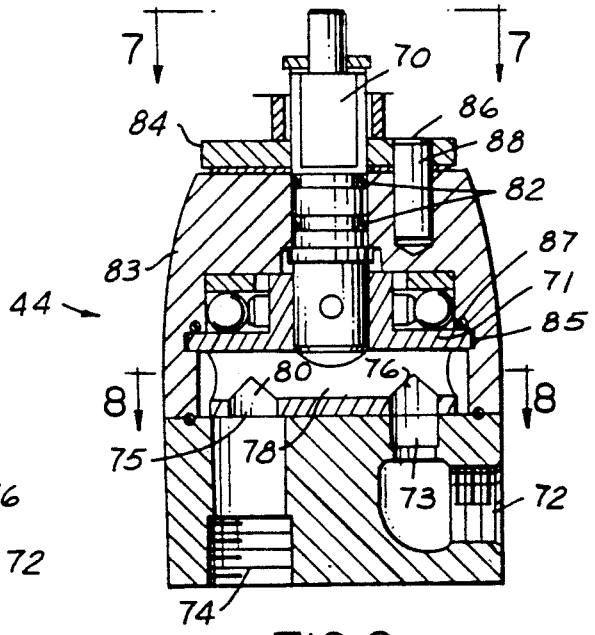
FIG. 6 is a cross-sectional view through a metering valve utilized with the present invention.

FIG. 6 shows details of rotary valve 44, including shaft 70 which is driven by an electric motor. Shaft 70 rotates plate 71 to meter fluid from inlet 72 to outlet 74. Inlet 72 extends to port 73 facing mating port 76 in valve plate 71, and outlet 74 extends to port 75 facing mating port 80 in valve plate 71. Ports 76 and 80 communicate through central passage 78. Valve plate 71 is driven to rotate relative to port 73 and 75 to vary the percentage of ports 76 and 80 aligned with ports 73 and 75, respectively. In this way, the amount of fluid dispensed to outlet 74 is controlled.

O-rings 82 are mounted between housing 83 and shaft 70 to ensure that air does not leak into valve 44 and contact the adhesive. Plate 84 rotates with shaft 70 and includes slot 86 which receives pin 88 fixed to housing 83. Slot 86, in combination with pin 88, provides a stop to prevent rotation of valve plate 71 relative to housing 83 beyond a limited extent. Further, plate 71 extends radially outwardly into groove 85 formed in body 83. O-ring face seal 87 is also preferably disposed in body 83 to prevent adhesive from passing plate 71.

Valve 44 is preferably formed of stainless steel at all areas which contact the fluid. Alternatively, Stellite TM inserts may be placed in the ports or on the plate.

Figure 7:
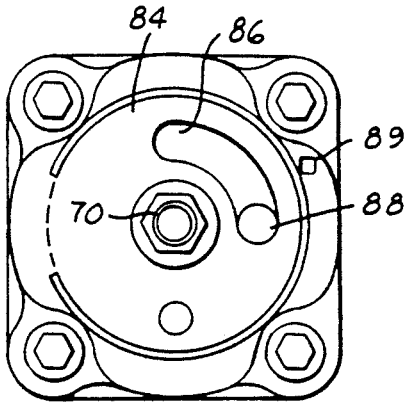
FIG. 7 is an end view along line 7—7 as shown in FIG. 6.

FIG. 7 shows details of the end of valve 44 when in a full-closed position. At this position pin 88 prevents further rotation. Also, limit switch 89, shown schematically, is actuated when plate 84 is in this position. The limit switch may be of the type actuated by a flange on plate 84, as is well-known in the art. When plate 84 and consequentially plate 71 is in this position motor 63 will detect an increased torque resisting further rotation due to pin 88 abutting an end of slot 86. This increase, and switch 89, both give an indication that the valve is in full-closed position.

Figure 8:
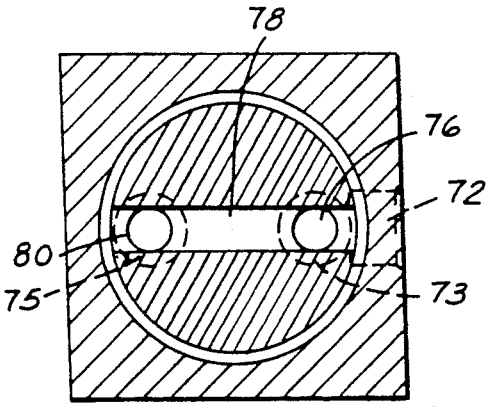
FIG. 8 is a cross-sectional view along line 8—8 in FIG. 6, showing a valve in a fully open position.

FIG. 8 illustrates a full flow position for valve 44. Port 76 is aligned with port 73 and port 80 is aligned with port 75. Fluid flows freely from inlet 72 to port 73, into port 76, along central passage 78, outwardly of port 80, into port 75 and then to nozzle 46.

Figure 9:
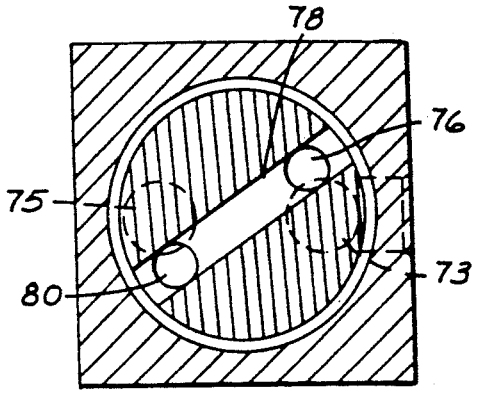
FIG. 9 is a view similar to FIG. 8, but showing the valve having been rotated through several degrees to a partially closed position.

As shown in FIG. 9, valve plate 71 has been rotated relative to the position shown in FIG. 8 to reduce the amount of fluid sent to port 75. Port 76 is partially aligned with port 73, and a similar relationship exists between ports 80 and 75. In this position, only a portion of the fluid dispensed in the position illustrated in FIG. 8 will be dispensed. By accurately controlling the position of valve plate 71 with respect to housing 83 it is possible to accurately control the amount of adhesive dispensed at dispensing point 24. Since valve plate 71 shears across the viscous fluid, the pressure of the fluid will not effect valve speed or accuracy.

As shown in FIG. 10, rotary valve 44 communicates outlet port 74 to a nozzle chuck 90 which receives nozzle tip 46. A pin 92 is received in a groove in both nozzle chuck 90 and nozzle tip 46 to connect the two, such that nozzle tip 46 may be removed to allow quick change by simply removing pin 92.

As shown, motor 63 is connected to speed reducer 93, received in mounting portion 94 of mounting arrangement 33. Mounting portion 94 includes a first generally rectangular bore 96 leading into a second cylindrical bore 98. Speed reducer 93 is generally rectangular at its outer periphery, and of a smaller dimension than bore 96. A cylindrical stop plate 102 is bolted in bore 98 to provide a stop for speed reducer 93. A shaft 104 extends from speed reducer 93 to connect to rotary valve 44.

FIG. 11 schematically illustrates a control for dispensing system 20. A robot control sends signals to control movement of the various portions of the robot, and also receives feedback from the robot. This feedback would include both position feedback and other feedback from sensors to determine whether the various motors and other systems on the robot are functioning properly.

A valve control combination includes a valve CPU unit which interfaces with the robot to supply positional feedback of the position of the valve to the robot, and also to receive feedback of the position of the robot to the valve. Further, the valve CPU unit sends and receives signals to the robot to indicate whether there are any fault situations on the valve or on the robot. If a fault is detected in either of the two systems, both systems are shut down.

The valve CPU unit also sends signals to a servo-motor control which is connected to motor 63 to control the position of valve plate 71. The CPU unit receives signals from the servo-motor control indicating that the control is functioning properly.

An operator interface terminal allows an operator to change variables within the valve CPU unit and consequently to change the speed or amounts of fluid which the valve CPU unit may direct the servo-motor control to achieve. The valve CPU unit also receives inputs from various sensors on the valve assembly such as limit switch 79, or proximity switch 69. These signals would also preferably include a signal from motor 63 that pin 88 is at an end of travel position in slot 86. These signals would give an indication to the valve CPU unit that valve plate 71 is in a full-closed position. Also, other signals which would give an indication of a fault somewhere within the system may be received by the valve CPU unit.

In a method according to the present invention, the valve CPU unit is programmed by the operator interface terminal to identify a plurality of zones on an item that is to receive adhesive, such as windshield 26, see FIG. 2. The CPU unit is initially programmed such that the movement of robot 30 to move valve assembly 32 through these zones is timed with the valve CPU unit to give direction to the servo-motor control to open or close valve plate 71 at appropriate times. Typically, a plurality of zones are identified on windshield 26 and each zone is assigned a desired amount of adhesive. That desired amount of adhesive is preferably programmed into the valve CPU unit by the operator interface terminal to be a corresponding rotational position of valve plate 71 which would allow the appropriate amount of adhesive to be dispensed. Further, valve speed is controlled. Thus, as the robot 30 moves valve assembly 32 about the surface of windshield 26 the valve CPU unit correspondingly opens and closes valve plate 71 to dispense an appropriate amount of adhesive onto windshield 26. If it is desired to change the amount at any one of the zones identified on windshield 26, such change can be easily made by the operator interface terminal.

The valve CPU unit orientates itself from a home position which is preferably the fully-closed position illustrated in FIG. 7. The CPU unit can determine that it is at this home position if the valve motor torque indicates that pin 88 is abutting an end of slot 86, and if limit switch 89 indicates that plate 84 is in the proper position. Preferably, the valve CPU unit will determine that plate 84, and consequently plate 71, is in the fully-closed position if such signals are received both from the motor and from limit switch 89. Robot 30 moves nozzle assembly 32 about the surface of windshield 26 and the valve control opens and closes valve plate 71 to dispense an appropriate amount of adhesive onto the surface of windshield 26. The speed that valve 44 may be changed allows rapid movement along the surface of windshield 26 and also rapid change of the amount of adhesive dispensed as the dispenser moves across the various zones.

Once a particular windshield is fully supplied with adhesive, robot 30 moves nozzle assembly 32 away from the windshield such that it may be removed and placed on a vehicle. At that time, robot 30 may be preferably moved over a waste container and a remainder amount of adhesive may be purged out of nozzle tip 46. This prevents any adhesive from hardening in nozzle tip 46 between application of adhesives to successive windshields.

In one working embodiment of the present invention, the system utilized a Kuka robot. Alternatively, a GMF robot may be utilized. The disclosed robot is of the GMF type. Any robot that can move a 50 pound end effector may be used. The adhesive being moved was a urethane adhesive that cured on contact with air, available under the trade name Betaseal ® 57502 from Essex Speciality Products, Inc. in Clifton, N.J., which is a subsidiary of Dow Chemical Co. The supply pump was used in combination with a pressure primer and developed pressures on the order of 6,000 psi to pump the adhesive to the pulse dampener chamber. The pulse dampener chamber was one-gallon, had an initial charge of 4,800 pounds per square inch and was of a type available from Greer Olaer Products, Los Angeles, Calif. The one-gallon is an idealized estimate of the volume of the variable chamber with the diaphragm in an exact center position. The pulse dampener chamber was modified to use a rolling diaphragm formed of Viton TM, available from DuPont, which is a polymer that is chemically inert when contacted by urethane. The servo-motor control was of a known type available under the trade name Powermate TM from GE Fanuc Automation. The other valve control elements used are also available to GE Fanuc. The robot control is supplied by the robot manufacturer. Lastly, lines 40 and 42 were Teflon ®-lined double braided steel tubing hose available under the trade name Titeflex ® from Titeflex Industrial America in Springfield, Mass.

A preferred embodiment of the present invention has been disclosed. However, a worker of ordinary skill in the art would recognize that certain modifications would come within the scope of this invention. Thus, the following claims should be studied in order to determine the true scope and content of the present invention.

What is claimed is:

1. A method of dispensing fluid comprising the steps of:

(1) forming a pulse removing member having a variable volume chamber and maintaining a force on the variable volume chamber tending to reduce its volume;

(2) supplying a viscous fluid to the pulse removing member, the pulse removing member including a T-connection with a first leg attached to the supply of viscous fluid, a second leg extending into the variable volume chamber and a third leg communicating with a variable demand dispensing point, such that fluid entering the first leg from the supply will pass into the third leg up to an amount demanded at the dispensing point, any excess fluid above that demanded at the dispensing point will pass through the second leg into the variable volume chamber, and should there be a deficiency in the fluid flow rate in the first leg, such that it is less than the fluid demanded at the dispensing point, that deficiency will be made up by fluid forced outwardly of the variable volume chamber and into the third leg; and (3) maintaining the force on the variable volume chamber tending to reduce its volume such that the viscous fluid moves out of the variable volume chamber and into the third leg at a rate demanded by the dispensing point.

2. The method as recited in claim 1, further including the steps of disposing a rotary metering valve at the dispensing point, and rotating the rotary metering valve to control the amount of viscous fluid dispensed.

3. The method as recited in claim 2, wherein the viscous fluid is an adhesive which is dispensed onto a first member that is to be attached to a second member.

4. The method as recited in claim 3, wherein the first member is a glass member and the second member is a vehicle body.

5. The method as recited in claim 4, wherein the dispensing point is moved along the glass member, and rotation of the rotary valve is synchronized with the position of the dispensing point along the glass member to control the amount of adhesive dispensed as a function of position on the glass member.

6. The method as recited in claim 5, wherein the dispensing point is connected to the arm of a robotic manipulator, and movement of the robot arm causes the movement of the dispensing point, and the pulse removing member is connected to a rotating base of said robotic manipulator.

7. A method as recited in claim 1, wherein the viscous fluid is an adhesive which is dispensed onto a first member that is to be attached to a second member.

8. The method as recited in claim 7, wherein the first member is a glass member, the second member is a vehicle body, and the adhesive is a urethane adhesive, which begins to cure upon contact with ambient air.

9. The method of dispensing an adhesive at a dispensing point comprising the steps of:

(1) supplying an adhesive to a metering nozzle at a dispensing point;

(2) disposing a rotary valve in the metering nozzle and rotating the rotary valve to control the amount of adhesive dispensed at the metering nozzle; and (3) dispensing the adhesive at various positions on a first member that is to be attached to a second member, and controlling the rotated position of the rotary valve to meter a desired minimum amount of adhesive at the various positions on the first member.

10. The method as recited in claim 9, wherein the first member is a glass member and the second member is a vehicle body.

11. The method as recited in claim 10, wherein the dispensing point is moved along the glass member by a robotic manipulator, and the rotary valve is rotated to control the amount of adhesive dispensed at various positions on the glass member as the dispensing point is moved.

12. The method as recited in claim 11, wherein the adhesive is a urethane adhesive which begins to cure upon contact with ambient air.

* * * * *